US006918369B2

(12) United States Patent
Takahashi

(10) Patent No.: US 6,918,369 B2
(45) Date of Patent: Jul. 19, 2005

(54) LUBRICATION SYSTEM FOR ENGINE

(75) Inventor: Masanori Takahashi, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/317,245

(22) Filed: Dec. 11, 2002

(65) Prior Publication Data

US 2003/0111037 A1 Jun. 19, 2003

(30) Foreign Application Priority Data

Dec. 14, 2001 (JP) ..... 2001-381730

(51) Int. Cl.[7] ..... F02B 75/06
(52) U.S. Cl. ..... 123/192.2; 123/196 R
(58) Field of Search ..... 123/195 P, 196 R, 123/192.2, 195 R; 440/88

(56) References Cited

U.S. PATENT DOCUMENTS

| | | | | |
|---|---|---|---|---|
| 4,616,610 A | | 10/1986 | Ishida | |
| 4,838,221 A | * | 6/1989 | Suemori | 123/195 H |
| 5,009,205 A | | 4/1991 | Abe et al. | |
| 5,305,656 A | * | 4/1994 | Kamiya et al. | 123/192.2 |
| 5,401,199 A | | 3/1995 | Shibata | |
| 5,461,940 A | | 10/1995 | Morita | |
| 5,537,968 A | | 7/1996 | Takahashi | |
| 5,572,959 A | | 11/1996 | Hedelin | |
| 5,687,686 A | | 11/1997 | Takahashi | |
| 5,704,819 A | | 1/1998 | Isogawa | |
| 5,752,866 A | | 5/1998 | Takahashi et al. | |
| 5,769,036 A | | 6/1998 | Takahashi et al. | |
| 5,778,847 A | | 7/1998 | Takahashi et al. | |
| 5,890,461 A | | 4/1999 | Iikura | |
| 5,904,604 A | | 5/1999 | Suzuki et al. | |
| 6,076,495 A | | 6/2000 | Takahashi et al. | |
| 6,099,374 A | | 8/2000 | Watanabe et al. | |
| 6,186,111 B1 | * | 2/2001 | Hilbig et al. | 123/192.2 |

FOREIGN PATENT DOCUMENTS

| | | |
|---|---|---|
| JP | 4-337143 | 11/1992 |
| JP | 9-273406 | 10/1997 |
| JP | 9-273407 | 10/1997 |

OTHER PUBLICATIONS

WO 01/27492 A1, Stuckler, Apr. 2001.*

* cited by examiner

*Primary Examiner*—Noah P. Kamen
(74) *Attorney, Agent, or Firm*—Knobbe, Martens, Olson & Bear, LLP

(57) ABSTRACT

A marine engine incorporates an engine body defining first and second bearing sections. A crankshaft is journaled at the first bearing section for rotation about a first axis extending generally vertically. A balancer shaft unit is journaled at the second bearing section for rotation. The balancer shaft unit includes two balancer shafts rotating about second and third axes both extending generally parallel to the first axis and also parallel to each other. The crankshaft rotates the balancer shafts. The balancer shafts have balancer weights. A lubrication system delivers lubricant to the first and second bearing sections.

15 Claims, 9 Drawing Sheets

LUBRICATION SYSTEM FOR ENGINE

PRIORITY INFORMATION

This application is based on and claims priority to Japanese Patent Application No. 2001-381730, filed on Dec. 14, 2001, the entire contents of which is hereby expressly incorporated by reference herein.

BACKGROUND OF THE INVENTION

1. Field of the Invention

The present invention generally relates to a lubrication system for an engine, and more particularly relates to a lubrication system for an engine incorporating a balancer shaft.

2. Description of Related Art

Marine engines, such as those incorporated in outboard motors, are used to power a marine propulsion device. The propulsion device typically is a propeller and is submerged when an associated watercraft rests on a body of water. The engine typically is placed atop the outboard motor. A drive train and a transmission couple the engine with the propulsion device. Typically, the engine has a crankshaft extending generally vertically. The drive train includes a driveshaft disposed within a housing unit below the engine. The driveshaft also extends generally vertically and is connected to the crankshaft to transfer the power output from the engine to a propeller shaft which also is included in the drive train. The transmission couples the propeller shaft with the driveshaft.

Outboard motors are typically mounted on a transom of an associated watercraft so as to tilt about a tilt or "trim" axis. Occasionally, two or more outboard motors are mounted in parallel to a watercraft to provide more powerful propulsion.

The engine can incorporate a rotating balancer shaft that has a weight configured to counter-act vibrations from other moving parts of the engine. With respect to a balancer shaft, some specific considerations should be made in connection with the marine engines. For example, the balancer shaft should not interfere with the tilt movement of the outboard motor. Additionally, the balancer shaft of one outbaord motor should interfere with another outboard motor mounted in parallel thereto. Japanese Patent Publication No. 4-337143 discloses an exemplary layout of such a balancer shaft in a marine engine.

The balancer shaft can be journaled by bearings within the engine for rotation about a generally vertically extending axis and be disposed generally parallel to the crankshaft. The crankshaft drives the balancer shaft with a gear connection, for example. Due to being rotated in a relatively high speed, the bearings of the balancer shaft need to be sufficiently lubricated.

Typically, the engine is provided with a lubrication system to lubricate engine portions such as, for example, bearings of the crankshaft. For instance, if the engine operates on a four-cycle combustion principle, a closed-loop type lubrication system can be employed. Lubricant in this system is delivered to the engine portions that need lubrication by a lubricant pump and then returns back to a lubricant tank disposed below the engine by its own weight. A secondary lubrication system can be used to lubricate the balancer shaft bearings, independently of the other parts of the engine.

SUMMARY OF THE INVENTION

One aspect of the present invention includes the realization that a disproportionate amount of oil can be supplied to the balancer shaft if a separate lubrication system is sued to lubricate the balancer shaft. In other words, an imbalance in lubricant amounts is likely to occur between the lubricant delivered to the balancer shaft bearings and the lubricant delivered to the other engine components.

Another aspect of the invention includes the realization that a balancer shaft for an engine can be disposed in a cranckase of the engine, and such a balancer shaft can be lubricated by providing branched lubricant passages connecting the lubricant supply passages of the crankshaft with the berings of the balancer shaft.

In accordance with another aspect of the present invention, an internal combustion engine comprises an engine body defining first and second bearing sections. A crankshaft is journaled at the first bearing section for rotation about a first axis extending generally vertically. A balancer shaft is journaled at the second bearing section for rotation about a second axis extending generally parallel to the first axis. The crankshaft rotates the balancer shaft. The balancer shaft has at least one balancer weight. A lubrication system includes first lubricant passages for supplying lubricant to the first bearing section. Additionally, a second lubricant passage is branched from the first lubricant passage to deliver lubricant to the second bearing section.

In accordance with another aspect of the present invention, an internal combustion engine comprises an engine body formed with a primary portion and a secondary portion. The primary portion defines an opening. The secondary portion closes the opening. The primary portion defines a first bearing section. The secondary portion defines a second bearing section. A crankshaft is journaled at the first bearing section for rotation about a first axis extending generally vertically. A balancer shaft is journaled at the second bearing section for rotation about a second axis extending generally parallel to the first axis. The crankshaft rotates the balancer shaft. The balancer shaft has at least one balancer weight. A lubrication system is arranged to lubricate the first and second bearing sections. The primary and secondary portions together define a lubricant passage through which lubricant flows from the primary portion to the secondary portion.

BRIEF DESCRIPTION OF THE DRAWINGS

These and other features, aspects and advantages of the present invention are described below with reference to the drawings of a preferred embodiment, which is intended to illustrate and not to limit the invention. The drawings comprise nine figures.

DETAILED DESCRIPTION OF THE PREFERRED EMBODIMENTS OF THE INVENTION

Figure 1:
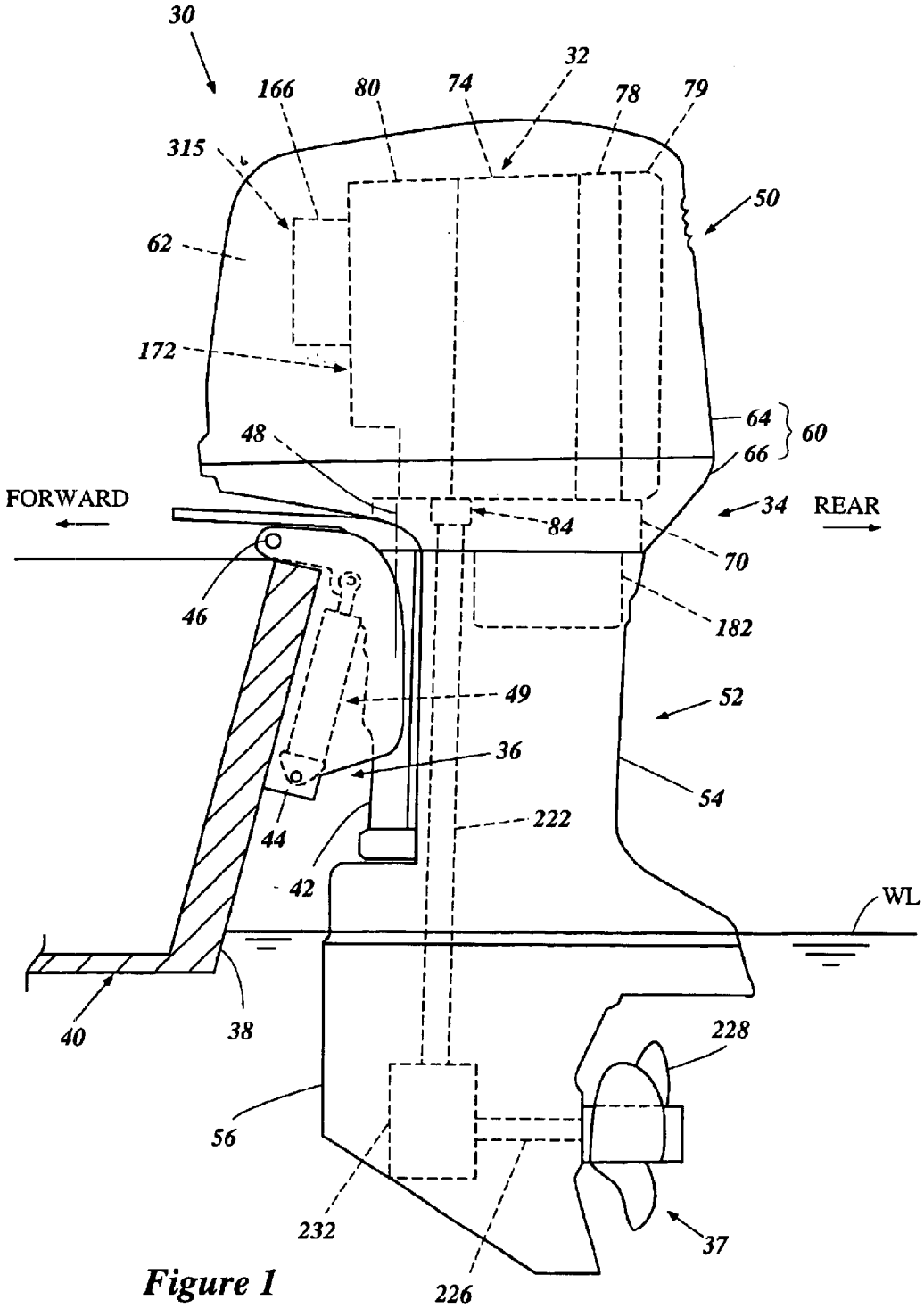
FIG. 1 is a side elevational view of an outboard motor that incorporates an engine configured in accordance with a preferred embodiment of the present invention. An associated watercraft also is illustrated partially and in cross-section.

With reference to FIGS. 1–5, an overall construction of an outboard motor 30 that incorporates an internal combustion engine 32 configured in accordance with certain features, aspects and advantages of the present invention is described below. The engine 32 has particular utility in the context of a marine drive, such as the outboard motor, and thus is described in the context of an outboard motor. The engine 32, however, can be used with other types of marine drives (i.e., inboard motors, inboard/outboard motors, jet drives, etc.) and also certain land vehicles. Furthermore, the engine 32 can be used as a stationary engine for some applications as is apparent to those of ordinary skill in the art in light of the description herein. In any of these applications, the engine 32 can be oriented vertically rather than horizontally.

The outboard motor 30 generally comprises a drive unit 34, a bracket assembly 36, and a marine propulsion device 37. The bracket assembly 36 supports the drive unit 34 on a transom 38 of an associated watercraft 40 and places the marine propulsion device 37 in a submerged position when the watercraft 40 rests on a surface of a body of water WL. The bracket assembly 36 preferably comprises a swivel bracket 42, a clamping bracket 44, a steering shaft 45 (FIG. 2) and a pivot pin 46.

Figure 2:
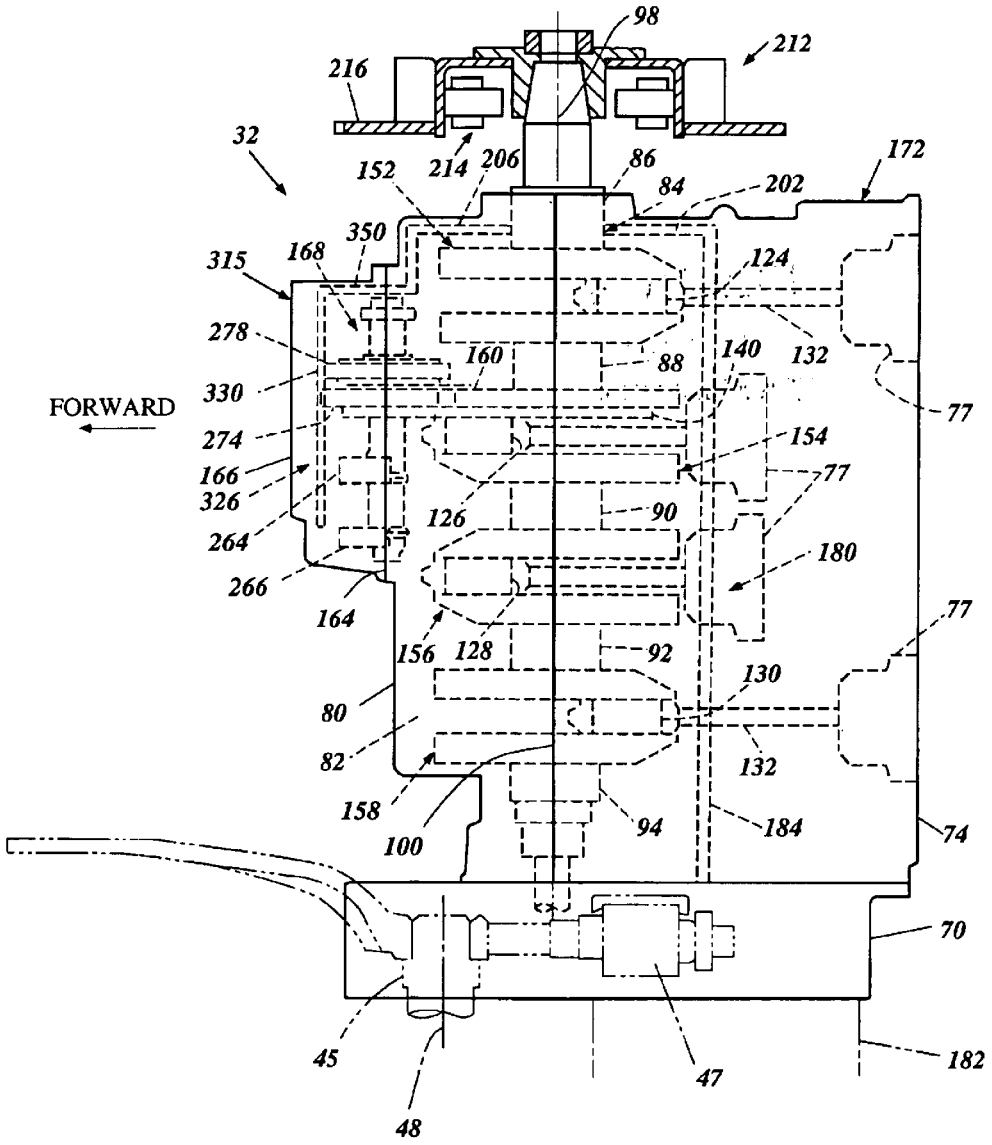
FIG. 2 is a side elevational view of the engine of FIG. 1 supported by a support member. A cylinder head member 78 of the engine is omitted in the figure. A steering shaft, a top mount assembly and a portion of a lubricant tank are partially illustrated in phantom. A flywheel assembly of the engine is illustrated in cross-section.

The steering shaft 45 typically extends through the swivel bracket 42 and is affixed to the drive unit 34 by top and bottom mount assemblies 47 (FIG. 2). The steering shaft 45 is pivotally journaled for steering movement about a generally vertically extending steering axis 48 defined within the swivel bracket 42. The clamping bracket 44 comprises a pair of bracket arms that are spaced apart from each other and that are affixed to the watercraft transom 38. The pivot pin 46 completes a hinge coupling between the swivel bracket 42 and the clamping bracket 44. The pivot pin 46 extends through the bracket arms so that the clamping bracket 44 supports the swivel bracket 42 for pivotal movement about a generally horizontally extending tilt axis defined by the pivot pin 46. The drive unit 34 thus can be tilted or trimmed about the pivot pin 46.

As used through this description, the terms "forward," "forwardly" and "front" mean at or toward the side where the bracket assembly 36 is located, and the terms "rear," "reverse," "backwardly" and "rearwardly" mean at or toward the opposite side of the front side, unless indicated otherwise or otherwise readily apparent from the context use.

A hydraulic tilt and trim adjustment system 49 preferably is provided between the swivel bracket 42 and the clamping bracket 44 for tilt movement (raising or lowering) of the swivel bracket 42 and the drive unit 34 relative to the clamping bracket 44. Otherwise, the outboard motor 30 can have a manually operated system for tilting the drive unit 34. Typically, the term "tilt movement," when used in a broad sense, comprises both a tilt movement and a trim adjustment movement.

The illustrated drive unit 34 comprises a power head 50 and a housing unit 52. The housing unit 52 includes a driveshaft housing 54 and a lower unit 56.

The power head 50 is disposed atop the drive unit 34 and includes the engine 32 and a protective cowling assembly 60. Preferably, the protective cowling 60 is made of plastic and defines a generally closed cavity 62 in which the engine 32 is disposed. That is, the cowling assembly 60 surrounds the engine 32. The protective cowling assembly 60 preferably comprises a top cowling member 64 and a bottom cowling member 66. The top cowling member 64 preferably is detachably affixed to the bottom cowling member 66 by a coupling mechanism. When the top cowling member 64 is detached, a user, operator, mechanic or repairperson can access the engine 32 for maintenance or for other purposes.

The top cowling member 64 preferably has a rear intake opening on its rear and top portion. Ambient air thus is drawn into the closed cavity 62 through the rear intake opening. Typically, the top cowling member 64 tapers in girth toward its top surface, which is in the general proximity of the air intake opening.

The bottom cowling member 66 preferably has an opening through which an upper portion of an engine support member 70 extends. The support member 70 preferably is made of aluminum alloy and is affixed atop the driveshaft housing 54. The bottom cowling member 66 and the support member 70 together generally form a tray. The engine 32 is placed onto this tray and is affixed to the support member 70. The support member 70 also has an exhaust passage through which burnt charges (e.g., exhaust gases) from the engine 32 are discharged.

The engine 32 in the illustrated embodiment preferably is a water-cooled, four-cycle engine. The engine 32 has a cylinder block 74. The presently preferred cylinder block 74 defines four in-line cylinder bores (not shown) which extend generally horizontally and which are generally vertically spaced from one another. As used in this description, the term "horizontally" means that the subject portions, members or components extend generally in parallel to the water line WL when the associated watercraft 40 is substantially stationary with respect to the water line WL and when the drive unit 34 is not tilted and is placed in the position shown in FIG. 1. The term "vertically" in turn means that portions, members or components extend generally normal to those that extend horizontally.

This type of engine, however, merely exemplifies one type of engine on which various aspects and features of the present invention can be suitably used. Engines having other numbers of cylinders, having other cylinder arrangements (V, W, opposing, etc.) and operating on other combustion principles (two-cycle, rotary, etc.) also can employ various features, aspects and advantages of the present invention.

A piston 77 reciprocates within each cylinder bore. A cylinder head member 78 is affixed to one end of the cylinder block 74 to close one end of the cylinder bores. The cylinder head member 78, together with the associated pistons 77 and cylinder bores, preferably defines four combustion chambers. Of course, the number of combustion chambers can vary, as indicated above. A cylinder head cover member 79 preferably covers the cylinder head member 78.

Figure 3:
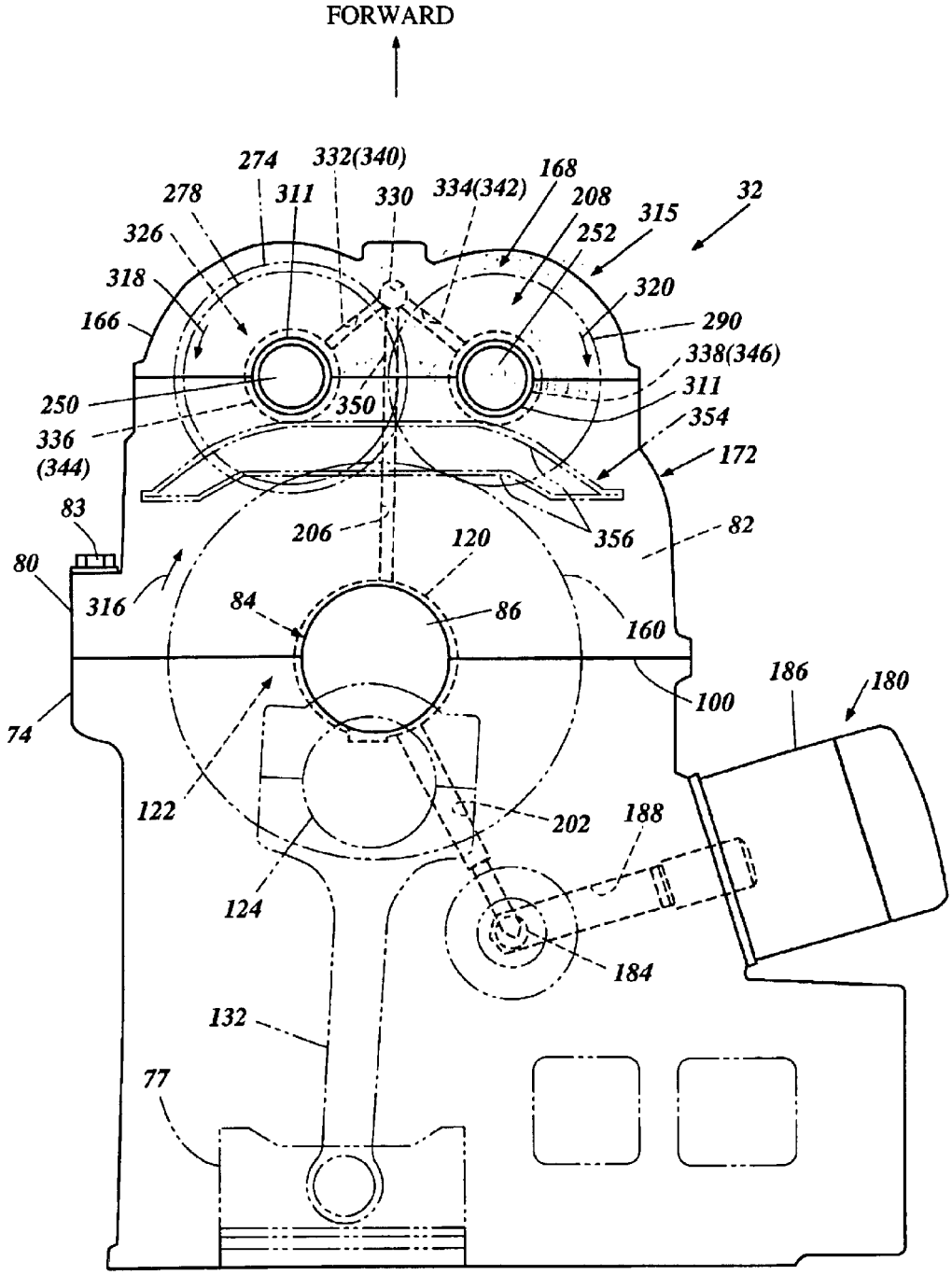
FIG. 3 is a partial top plan view of the engine. A cylinder head member is omitted.
Figure 4:
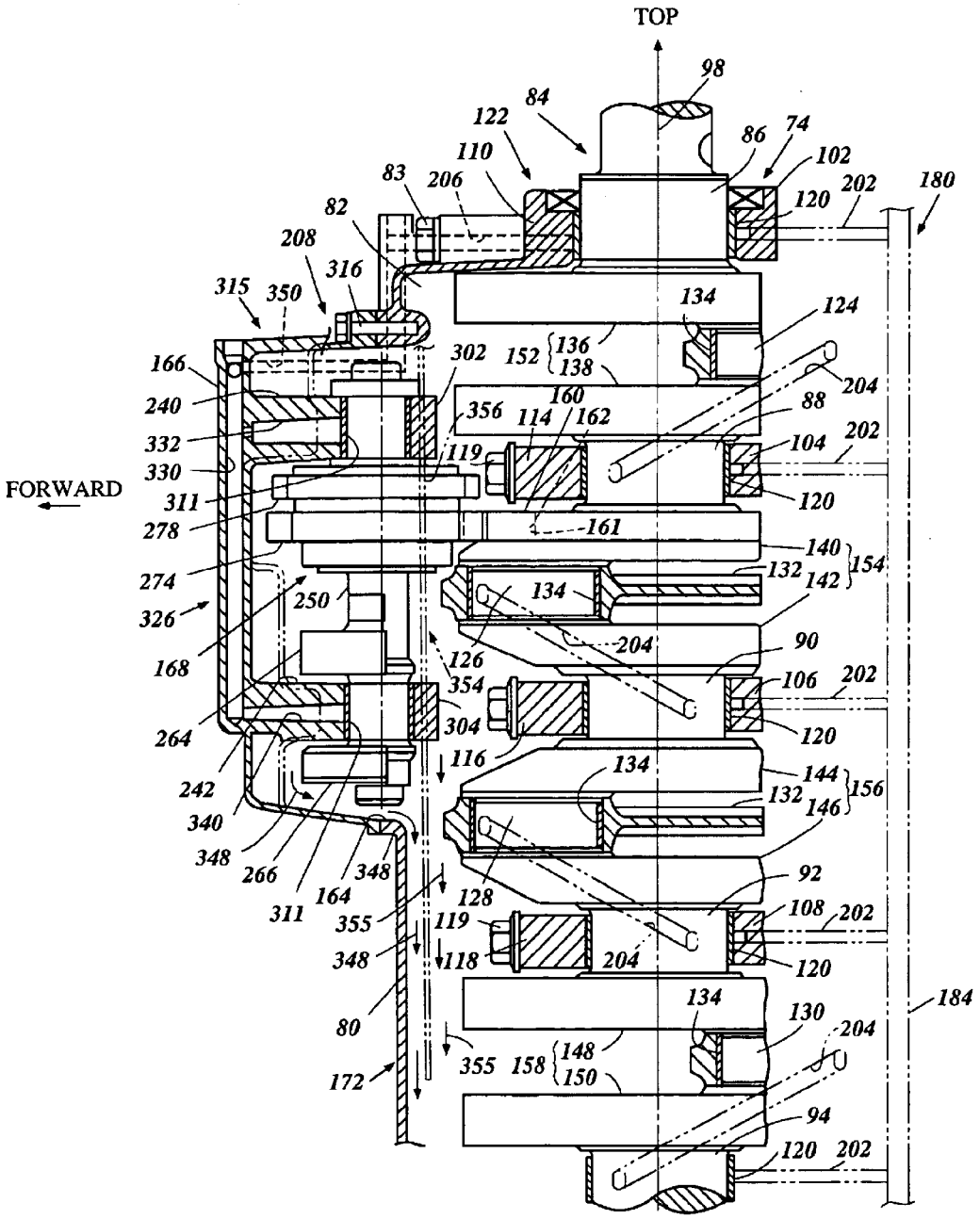
FIG. 4 is a cross-sectional, side elevational view of a primary portion of the engine.

A crankcase member 80 closes the other end of the cylinder bores and, together with the cylinder block 74, defines a crankcase chamber 82. The crankcase member 80 is affixed to the cylinder block 74 by several bolts 83 (FIGS. 3 and 4). A crankshaft 84 extends generally vertically through the crankcase chamber 82. The crankshaft 84 rotates with the reciprocal movement of the pistons 77. The illustrated crankshaft 84 comprises five crank journals 86, 88, 90, 92, 94 from the top to the bottom. These crank journals 86, 88, 90, 92, 94 are spaced apart vertically from one another with the same distance.

The crankshaft 84 is journaled for rotation about a longitudinal axis 98 extending generally vertically. In the illustrated arrangement, the axis 98 extends on and along a meeting plane 100 (FIGS. 2 and 3) where the cylinder block 74 and the crankcase member 80 meet with each other.

Five bearing blocks 102, 104, 106, 108, which are disposed from the top to the bottom, extend toward the crankcase member 80 from the cylinder block 74 and the crankshaft 84 is positioned on the bearing blocks 102, 104, 106, 108. The lower-most bearing block extending from the cylinder block 74 is not shown. Two bearing blocks 110, which are disposed atop and at the bottom, extend toward the cylinder block 74 from the crankcase member 80. The lower-most bearing block extending from the crankcase member 80 is not shown. The upper-most bearing blocks 102, 110 and the lower-most bearing blocks together journals the crankshaft 84 therebetween, respectively. Also, three bearing caps 114, 116, 118, which are disposed from the top to the bottom, interpose the crankshaft 84 with the bearing blocks 104, 106, 108, respectively. The bearing caps 114, 116, 118 are affixed to the associated bearing blocks 104, 106, 108 by bolts 119. Journal bearings 120 are provided at the respective journal portions.

The illustrated bearing blocks 102, 104, 106, 108, 110 (including other two), the bearing caps 114, 116, 118 and the journal bearings 120 together form a first bearing section 122.

The crankshaft 84 also comprises four crank pins or rod journals 124, 126, 128, 130 disposed from the top to the bottom. Each crank pin 124, 126, 128, 130 is positioned between two of the crank journals 86, 88, 90, 92, 94. Connecting rods 132 connect the crankshaft 84 with the respective pistons 77. A big end of each connecting rod 132 is coupled with each crank pin 124, 126, 128, 130. Journal bearings 134 are provided between the crank pins 124, 126, 128, 130 and the respective big ends of the connecting rods 132.

The crankshaft 84 further comprises eight crank webs or counter weights 136, 138, 140, 142, 144, 146, 148, 150 disposed from the top to the bottom. The webs 136, 138 together form a pair 152 of weights and are placed on both sides of the crank pin 124 and between the crank journals 86, 88. The other crank webs 140, 142, 144, 146, 148, 150 also form three pairs 154, 156, 158 similarly and placed in the same manner. The crank web 140 just above the crank pin 126 has a special shape that differs from the other webs because a drive gear 160 is affixed thereto.

The illustrated crankshaft 84 is made of iron. The crank journals 86, 88, 90, 92, 94, the crank pins 124, 126, 128, 130 and the crank webs 136, 138, 140, 142, 144, 146, 148, 150 are unitarily formed in a forging process. Alternatively, the crankshaft 84 can be divided into several portions and be assembled with each other.

Figure 5:
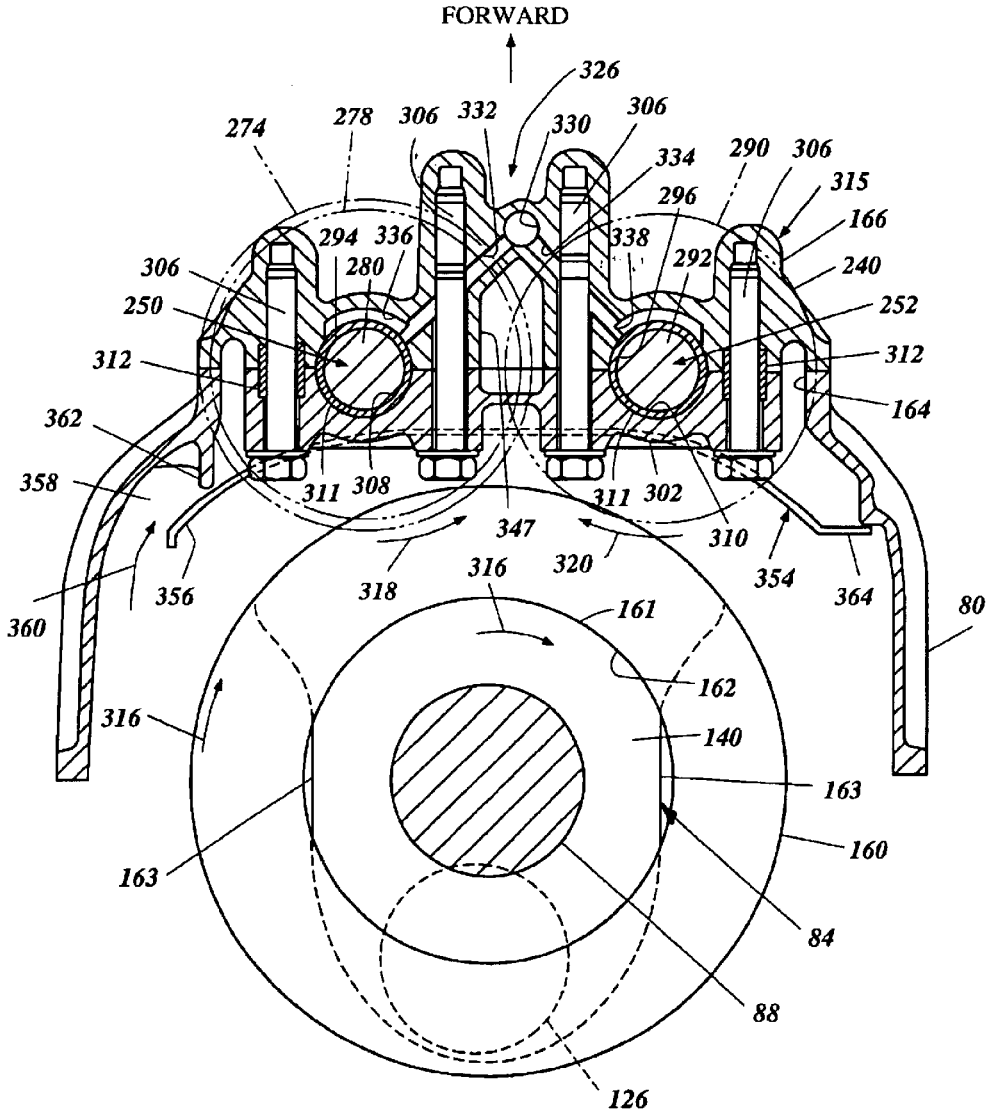
FIG. 5 is a cross-sectional, top plan view of a bearing section for a balancer shaft unit. The balancer shaft unit and a crankshaft are shown in cross-section. A drive gear is illustrated around the crankshaft. Driven gears driven by the drive gear also are illustrated in phantom.

With particular reference to FIGS. 4 and 5, the illustrated drive gear 160 is separately prepared and affixed to the crank web 140. The crank web 140 defines a circular portion 161 that is generally formed circular except for a pair of chamfers 163. The circular portion 161 is a concentric circle as the crank journal 88 and has an outer diameter greater than an outer diameter of the crank journal 88. The drive gear 160 defines an opening 162 that has an inner diameter that is the same as the outer diameter of the circular portion 161. The circular portion 161 thus fits in the opening 162. The outer and inner diameters of the circular portion 161 and the opening 162, respectively, are determined so as to allow the crank webs 136, 138 to pass through the opening 162 one by one by inclining the drive gear 160. The illustrated drive gear 160 preferably is shrinkage-fitted or press-fitted to the circular portion 161 of the crank web 140. Other fixing manners are applicable.

The separate gear construction is advantageous because the outer diameter of the drive gear 160 can be extremely decreased. That is, if the gear 160 is unitarily formed with the crankshaft 84, the gear 160 needs an outer diameter at least equal to or larger than the diameter of the crank webs 152, 154, 156, 158 for a gear cutting process.

The crankcase member 80 defines an opening 164 (FIGS. 2 and 4) preferably at a front and upper portion thereof. A balancer shaft housing 166 is disposed at this location and is affixed to the crankcase member 80 to close the opening 164. A balancer shaft unit 168 is journaled for rotation within the balancer shaft housing 166. The balancer shaft housing 166 and the balancer shaft unit 168 will be described in greater detail below.

In the illustrated arrangement, the balancer shaft housing 166 is located at the forward-most position of the engine 32, with the crankcase member 80, the cylinder block 74, the cylinder head member 78 and the cylinder head cover member 79 being disposed rearward from the balancer shaft housing 166. As thus described, however, the balancer shaft housing 166 is only affixed to the crankcase member 80. Generally, the cylinder block 74, the cylinder head member 78, the cylinder head cover member 79 and the crankcase member 80 with the balancer shaft housing 166 together define an engine body 172. Preferably, at least these major engine portions 74, 78, 79, 80 and the balancer shaft housing 166 are made of an aluminum alloy. The aluminum alloy advantageously increases strength over cast iron while decreasing the weight of the engine body 124.

The engine 32 can be formed with separate cylinder bodies rather than a number of cylinder bores formed in the cylinder block 74. In general, regardless of the particular construction, the engine preferably comprises such an engine body that includes at least one cylinder bore.

The engine 32 preferably comprises an air induction system, a fuel supply system, an ignition system and an exhaust system, all of which are not shown. The air induction system introduces air in the closed cavity 62 to the combustion chambers. The fuel supply system supplies fuel to the combustion chambers so as to make air/fuel charges within the combustion chambers. Various fuel injection devices or carburetors can form the fuel supply system. The ignition system fires the air/fuel charges in the combustion chambers. The exhaust system routes the burnt charges, i.e., the exhaust gases, in the combustion chambers to a location out of the outboard motor 30. Typically, the exhaust gases are discharged through the engine support member 70, the driveshaft housing 54, the lower unit 56 and the marine propulsion device 37 as described below.

Generally, during the intake stroke of the engine 32, air is drawn into the combustion chambers 110 and fuel also is supplied to the combustion chambers. The air and the fuel are mixed to form the air/fuel charges in the combustion chambers and compressed by the pistons 77. Slightly before or during the power stroke, the ignition system fires the compressed air/fuel charges in the combustion chambers. The air/fuel charges thus rapidly burn during the power stroke to move the pistons 77. The burnt charge, i.e., exhaust gases, then are discharged from the combustion chambers during the exhaust stroke. The pistons 77 thus move reciprocally within the cylinder bores. With the reciprocal movement of the pistons 77, the crankshaft 84 rotates because the connecting rods 132 connect the crankshaft 84 with the pistons 77.

The engine 32 also comprises a lubrication system 180. A closed-loop type system preferably is employed in the illustrated arrangement. The lubrication system 180 preferably comprises a lubricant tank 182 (FIGS. 1 and 2) that is positioned within the driveshaft housing 54. An oil pump (not shown) is provided to pressurize the lubricant in the tank 182 toward a main gallery 184 formed within the engine body 172 through an oil strainer (not shown) and an oil filter 186. The oil pump preferably is located around the crankshaft 84 so as to be driven thereby. The oil strainer preferably is disposed within the lubricant tank 182 so that no foreign substances in the tank 182 are drawn to the main gallery 184. The oil filter 186 is disposed at a side surface of the cylinder block 74 on the starboard side (right hand side) to further remove foreign substances, if any, in the lubricant. A supply passage 188 (FIG. 3) defined in the cylinder block 74 connects the oil filter 186 with the main gallery 184.

The illustrated main gallery 184 is formed in the cylinder block 74 and extends generally vertically along the crankshaft 84 toward the bearing block 102. Five branch passages 202 are branched off from the main gallery 184 and are formed in the cylinder block 74. The illustrated branch passages 202 are provided to deliver the lubricant primarily to the respective journal bearings 120 of the first bearing section 122. The illustrated branch passages 202 are defined at outer and inner walls of the cylinder block 74. For example, the upper-most branch passage 202 is formed within the top wall of the cylinder block 74. Four delivery passages 204 also are formed within the crankshaft 84 to deliver a portion of the lubricant to the journal bearings 134 of the crank pins 124, 126, 128, 130. That is, each delivery passage 204 connects each journal bearing 134 with the journal bearing 120 positioned just below the each journal bearing 120. The delivery passages 204 can further extend to the pistons 77 to deliver a further portion of the lubricant.

As thus described, the lubricant at least in part is delivered to the first bearing section 122, the journal bearings 134 of the crank pins 124, 126, 128, 130 and the pistons 77 to lubricate such portions. In the illustrated arrangement, the branch passage 202 positioned at the top of the branch passages 202 is coupled with a delivery passage 206 that extends toward the balancer shaft housing 166 to deliver a portion of the lubricant for lubrication of a second bearing section 208 of the balancer shaft unit 168. The second bearing section 208 and the lubrication thereof will be described in greater detail below.

The lubricant that has lubricated the first bearing section 122 and the journal bearings 134 is scattered by the relatively high speed rotation of crankshaft 84. The scattered lubricant adheres on inside walls of the crankcase member 80 and the cylinder block 74 and then falls down to the lubricant tank 182 by its own weight through surfaces of the inside walls. The lubricant then re-circulates in the same manner.

A flywheel assembly 212 (FIG. 2) preferably is positioned atop the crankshaft 84. A flywheel magneto 214 is formed inside of the assembly 212, while a ring gear 216 is formed outside of the assembly 212. The flywheel magneto 214 is an AC generator that supplies electric power to various electrical components. The ring gear 216 meshes with a gear of a starter motor (not shown) that rotates the crankshaft 84 when the engine 32 is started.

With reference back to FIG. 1, the driveshaft housing 54 depends from the power head 50. A driveshaft 222 extends generally vertically within the driveshaft housing 54 and is journaled on the driveshaft housing 54 for rotation. The driveshaft 222 is coupled with the crankshaft 84 to be driven thereby. The driveshaft housing 54 preferably defines an internal section of the exhaust system that leads the majority of exhaust gases to the lower unit 56. An idle discharge section is branched off from the internal section to discharge idle exhaust gases directly out to the atmosphere through a discharge port that is formed on a rear surface of the driveshaft housing 54 in idle speed of the engine 32.

The lower unit 56 depends from the driveshaft housing 54 and supports a propulsion shaft 226 that is driven by the driveshaft 222. The propulsion shaft 226 extends generally horizontally through the lower unit 56 and is journaled for rotation. The propulsion device 41 is attached to the propulsion shaft 226. In the illustrated arrangement, the propulsion device 41 includes a propeller 228 that is affixed to an outer end of the propulsion shaft 226. The propulsion device, however, can take the form of a dual counter-rotating system, a hydrodynamic jet, or any of a number of other suitable propulsion devices.

A transmission 232 preferably is provided between the driveshaft 222 and the propulsion shaft 226, which lie generally normal to each other (i.e., at a 90° shaft angle) to couple together the two shafts 222, 226 by bevel gears. The transmission 232 includes a switchover mechanism (not shown) that is configured to change a rotational direction of the propeller 228 between forward, neutral or reverse.

The lower unit 56 also defines an internal section of the exhaust system that is connected with the internal section of the driveshaft housing 54. At engine speeds above idle, the exhaust gases generally are discharged to the body of water surrounding the outboard motor 30 through the internal sections and then through a discharge section defined within the hub of the propeller 228. Preferably, the outboard motor 30 also includes an idle exhaust discharge (not shown) configured to discharge exhaust gases to the atmosphere at a position above the waterline WL at idle engine speeds.

With continued reference to FIGS. 2–5 and with additional reference to FIGS. 6–9, the foregoing balancer shaft housing 166 has an upper bearing block 240 and a lower bearing block 242. The upper and lower bearing blocks 240, 242 are spaced apart vertically from one another. The upper and lower bearing blocks 240, 242 extend toward the crankshaft 84 when the housing 166 is affixed to the crankcase member 80.

Figure 6:
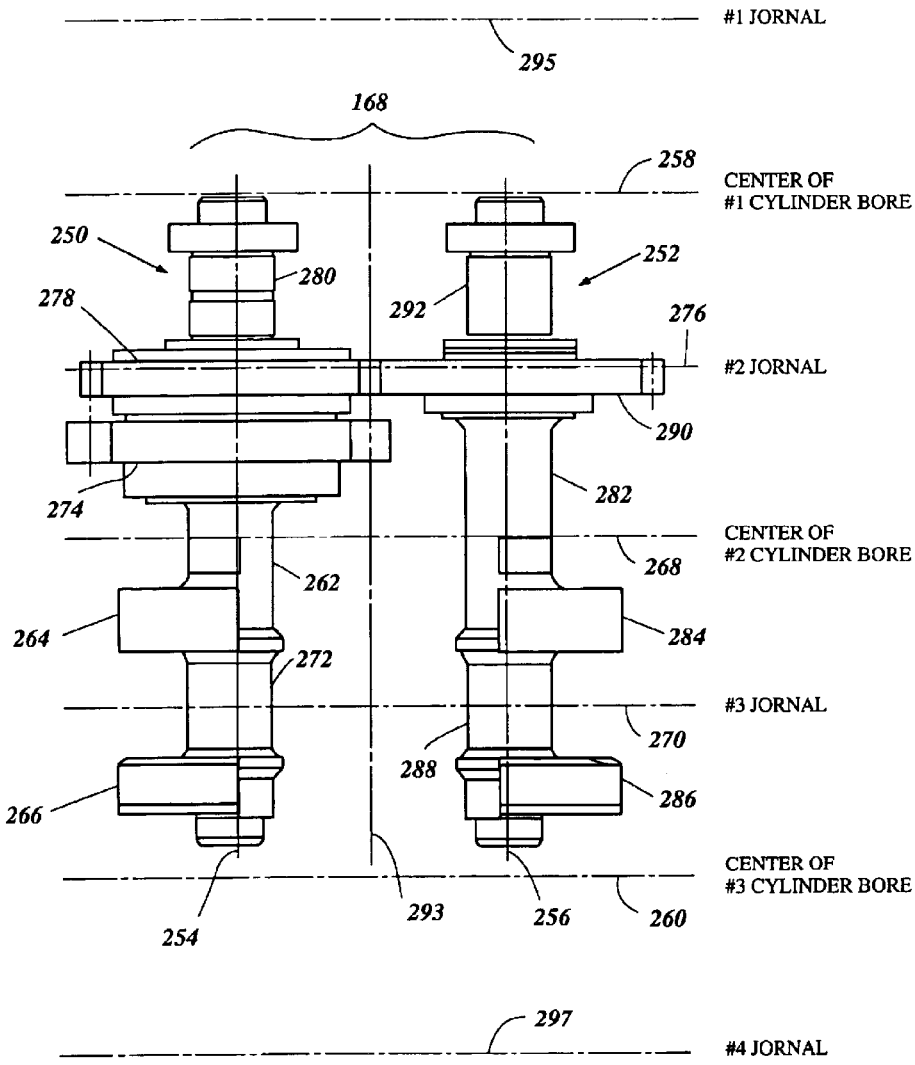
FIG. 6 is a side elevational view of the balancer shafts of FIG. 5. Other engine portions are not illustrated in this figure.

With particular reference to FIG. 6, the illustrated balancer shaft unit 168 comprises a pair of balancer shafts 250, 252. Both the balancer shafts 250, 252 extend generally vertically. A longitudinal axis 254 of the balancer shaft 250 and a longitudinal axis 256 extend parallel to each other and also parallel to the longitudinal axis 98 of the crankshaft 84. Both the illustrated balancer shafts 250, 252 are positioned between a line 258 extending through a center of the upper-most cylinder bore (first cylinder bore) and a line 260 extending through a center of the cylinder bore (third cylinder bore) disposed at third from the upper-most cylinder bore in the vertical view.

The balancer shaft 250 basically comprises a shaft portion 262. The illustrated balancer shaft 250 also comprises upper and lower balancer weights 264, 266 that are spaced apart vertically from each other. The upper weight 264 is positioned between a line 268 extending through a center of the cylinder bore (second cylinder bore) disposed at second from the upper-most cylinder bore and a line 270 extending through the combination of the bearing block 106 and the bearing cap 116 (third journal). The lower weight 266, in turn, is positioned between the line 270 and the line 260. In other words, the balancer weights 264, 266 together interpose the line 270. This arrangement is advantageous because the balancer weights 264, 266 rotate at the location corresponding to the right middle level of the crankshaft 84 and thus can well contribute to reduce the vibration of the engine 32. The illustrated balancer shaft 250 defines a lower journal 272 between the balancer weights 264, 266 and on the line 270.

The balancer shaft 250 further comprises a driven gear 274 that meshes with the drive gear 160 of the crankshaft 84 and is driven thereby. The illustrated driven gear 274 is positioned between a line 276 extending through the combination of the bearing block 104 and the bearing cap 114 (second journal) and the line 268. The balancer shaft 250 still further comprises a drive gear 278. The drive gear 278 is positioned just above the driven gear 274 and on the line 276 (second journal). An outer diameter of the drive gear 278 is generally the same as an outer diameter of the driven gear 274 and is half the size of the drive gear 160. The illustrated balancer shaft 250 defines an upper journal 280 above the drive gear 278 and between the lines 258, 276.

The illustrated balancer shaft 250 is made of iron. The balancer weights 264, 266 and the driven and drive gears 274, 278 are preferably unitarily formed with the shaft portion 262 in a forging process. Alternatively, the balancer shaft 250 can be divided into several portions and be assembled with each other.

On the other hand, the balancer shaft 252 basically comprises a shaft portion 282. The illustrated balancer shaft 252 also comprises upper and lower balancer weights 284, 286 that are spaced apart vertically from each other. The upper weight 284 is positioned between the lines 268, 270 and on the same level as the upper weight 264 of the balancer shaft 250. The lower weight 286 is positioned between the lines 270, 260 and on the same level as the lower weight 266 of the balancer shaft 250. The same advantages as described above in connection with the balancer shaft 250 are also true with the balancer shaft 252. The illustrated balancer shaft 252 defines a lower journal 288 between the balancer weights 284, 286 and on the line 270.

The balancer shaft 252 further comprises a driven gear 290. The driven gear 290 is positioned on the same level as the drive gear 278 of the balancer shaft 250 and on the line 276. The driven gear 290 meshes with the drive gear 278 and is driven thereby. A diameter of the driven gear 290 is the same as the diameter of the drive gear 278. The illustrated balancer shaft 252 defines an upper journal 292 above the driven gear 290 and between the lines 258, 276.

The illustrated balancer shaft 252 is made of iron. The balancer weights 284, 286 and the driven gear 290 preferably are unitarily formed with the shaft portion 282 in a forging process. Alternatively, the balancer shaft 252 can be divided into several portions and be assembled with each other.

Both the balancer shafts 250, 252 are disposed symmetrically relative to a vertical plane 293 extending vertically and incorporates a mesh point where the drive and driven gears 278, 290 mesh with each other.

Additionally, the lines 295, 297 of FIG. 6 indicate the levels of the combination of the bearing blocks 102, 110, and the combination of the bearing block 108 and the bearing cap 118, respectively (first and fourth journals).

Figure 7:
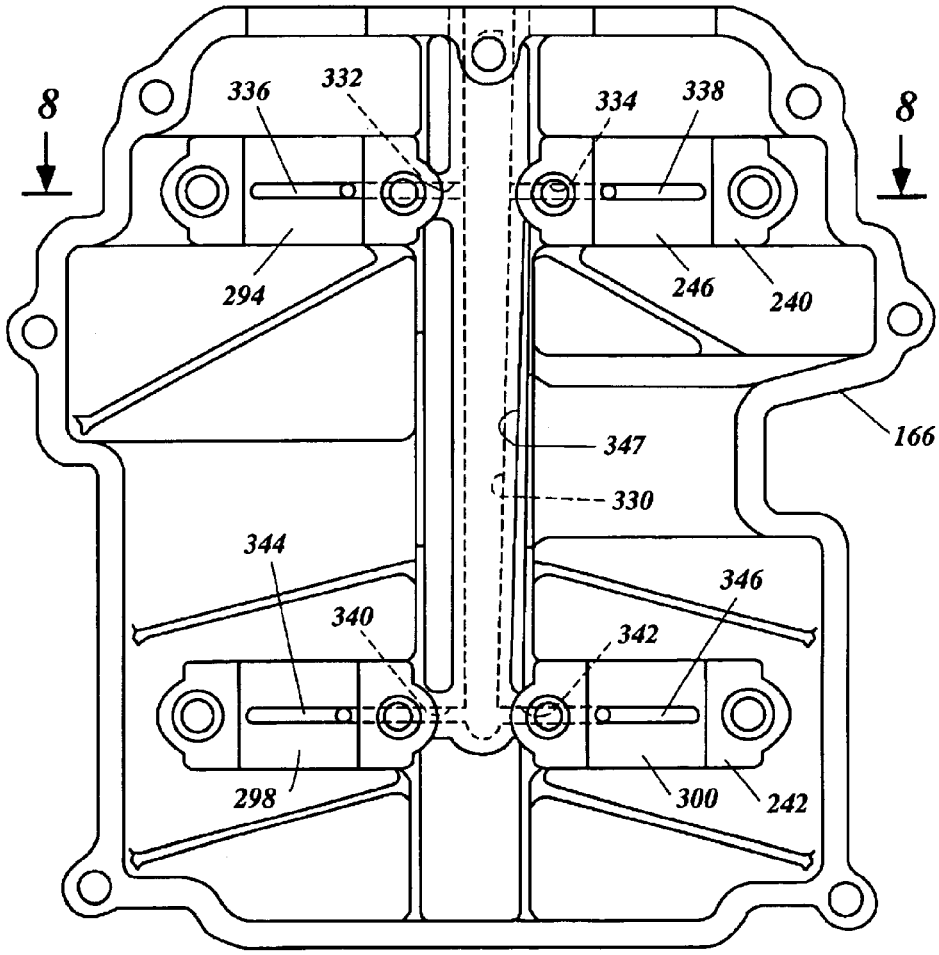
FIG. 7 is a rear view of a balancer shaft housing.
Figure 8:
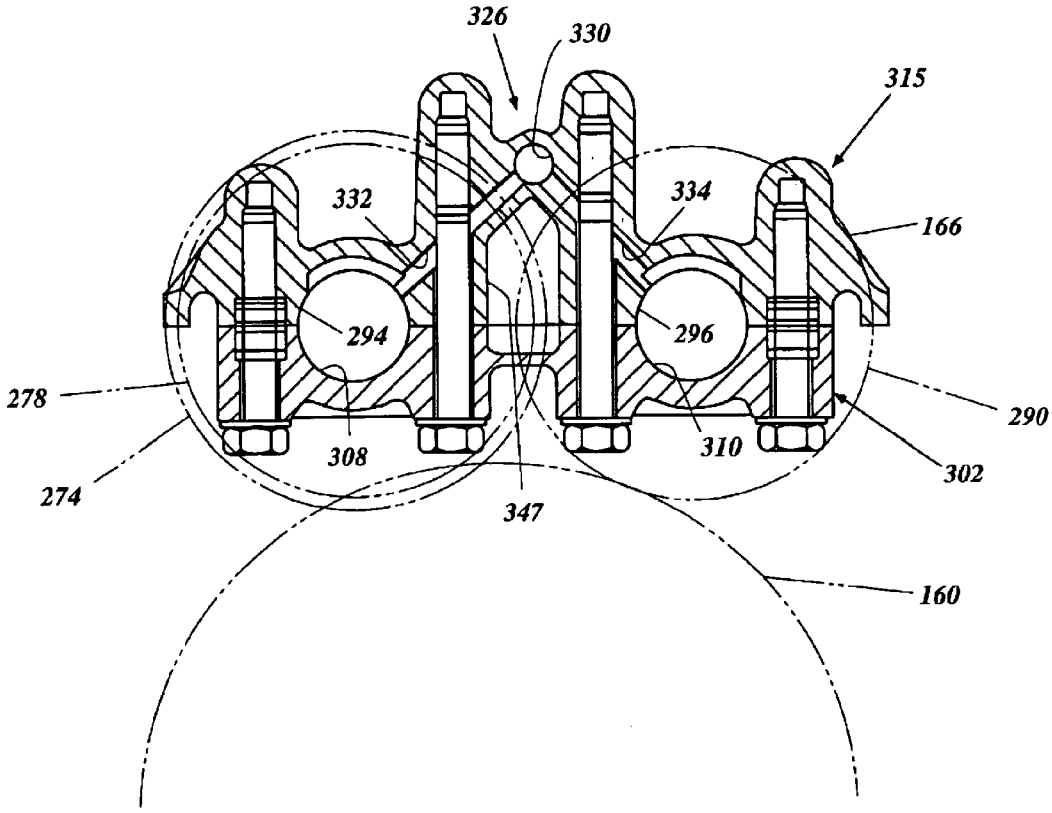
FIG. 8 is a cross-sectional view of the bearing section for the balancer shaft unit taken along the line 8—8 of FIG. 7.
Figure 9:
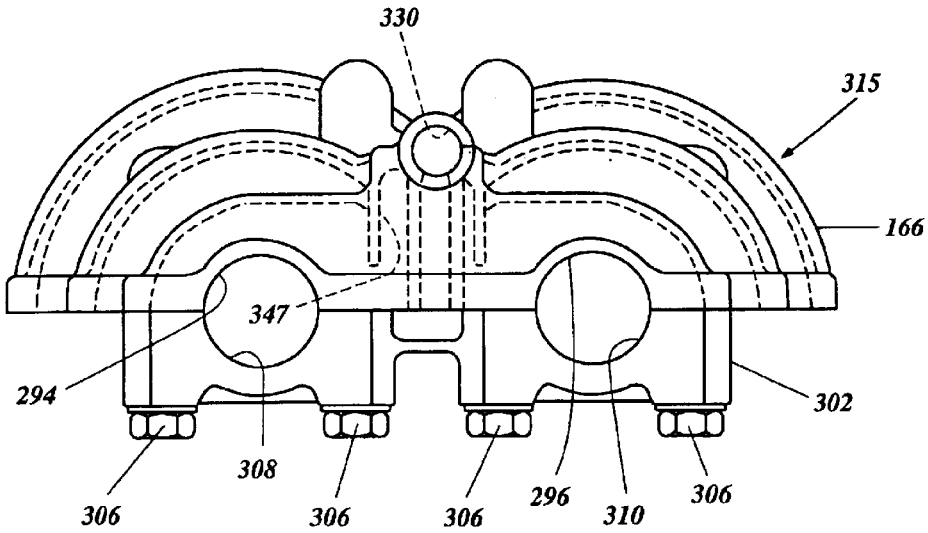
FIG. 9 is a top plan view of a balancer module incorporating the balancer shaft housing and the balancer shaft unit.

With particular reference to FIGS. 5, 7 and 9, the upper bearing block 240 forms two recesses 294, 296 and the lower bearing block 242 also forms two recesses 298, 300 at the same locations. The upper and lower journals 280, 292, 272, 288 of the balancer shafts 250, 252 are journaled at those recesses 294, 296, 298, 300 for rotation about the axes 254, 256, respectively. Upper and lower bearing caps 302, 304 are affixed to the balancer shaft housing 166 by several bolts 306 so as to interpose the journals 280, 292, 272, 288 with the balancer shaft housing 166. That is, the upper bearing cap 302 has recesses 308, 310 that are similar to the recesses 294, 296 and the upper journals 280, 292 are placed therebetween. Although not shown, the lower bearing cap 304 has recesses that are similar to the recesses 298, 300 and the lower journals 272, 288 are placed therebetween. Journal bearings 311 preferably are disposed between the journals 280, 292, 272, 288 and the recesses 294, 296, 298, 300. The upper and lower bearing blocks 240, 242, the bearing caps 302, 304 and the journal bearings 311 together form the second bearing section. Some of the bolts 306 have seal members 312 therearound and on the meeting surfaces where the bearing caps 302, 304 meet with the balancer shaft housing 166. The seal members 312 seal the meeting surface of the housing 166 with the crankcase member 80 such that lubricant in the housing 166 does not leak out.

As thus described, both the balancer shafts 250 and 252 of the illustrated balancer shaft unit 168 is assembled with the balancer shaft housing 166. In other words, the balancer shaft unit 168 and the balancer shaft housing 166 together form a balancer module 315. The module 315 is affixed to the crankcase member 172 by several bolts 316 (FIG. 4) such that the driven gear 274 of the balancer shaft 250 meshes with the drive gear 160 of the crankshaft 84. Because the module 315 closes the opening 164, the crankcase chamber 82 is completed. The balancer module 315 is advantageous because the module 315 can be handled quite easily.

With particular reference to FIGS. 3 and 5, when the drive gear 160 on the crankshaft 84 rotates clockwise as indicated by the arrows 316, the driven gear 274 and the drive gear 278 on the balancer shaft 250 rotate anti-clockwise as indicated by the arrow 318. Simultaneously, the driven gear 290 on the balancer shaft 252 rotates clockwise as indicated by the arrow 320. Because the diameter of the drive and driven gears 278, 290 is half smaller than the diameter of the drive gear 160, the drive and driven gears 278, 290 rotates twice faster than the drive gear 160. Thus, the vibration of the engine 32 is inhibited effectively.

With reference to FIGS. 2–5 and 7–9, the illustrated balancer module 315 incorporates a lubricant delivery system 326 that deliver lubricant to the journal bearings 311. The lubricant delivery system 326 comprises a main delivery path 330 extending generally vertically in a forward portion of the balancer shaft housing 166. The main path 330 is positioned at a location which is spaced apart from the respective bearing journals 310 with an equal distance. Upper delivery paths 332, 334 extend through the upper bearing block 240 to connect the main path 330 with lubricant grooves 336, 338 formed at the recesses 294, 296, respectively. Also, lower delivery paths 340, 342 extend through the lower bearing block 242 to connect the main path 330 with lubricant grooves 344, 346 formed at the recesses 298, 300, respectively. The illustrated grooves 336, 338, 344, 346 do not completely surround the balancer shafts 250, 252. Alternatively, however, those grooves can entirely surround the balancer shafts 250, 252. FIG. 3 illustrates the alternative grooves.

A coupling path 350 also is defined within the balancer shaft housing 166 to couple the main path 330 with the foregoing delivery passage 206 defined within the crankcase member 80. Thus, the lubricant in the main gallery 184 is delivered to the main path 330 through the branch passage 202 and the delivery passage 206 and the coupling path 350. The lubricant in the main path 330 is further delivered to the respective bearing journals 310 through the delivery paths 332, 334, 340, 342 and the grooves 336, 338, 344, 346 and lubricates the bearing journals 310. The balancer shaft housing 166 and the bearing caps 302, 304 together define a return path 347 extending next to the main path 330 and parallel to the main path 330. The return path 347 collects the lubricant that has lubricated the bearing journals 310 and guides the lubricant toward the lubricant tank 182. The lubricant thus smoothly returns to the lubricant tank 182 by its own weight though the return path 347 as indicated by the arrows 348 of FIG. 4.

As thus described, the illustrated balancer module 315 is supplied with the lubricant from the main gallery 184. Accordingly, the entire lubrication construction or arrangement is simple and also can deliver a proper amount of lubricant to the balancer module 315 in comparison with other portions of the engine 32.

In addition, the illustrated delivery paths in the balancer module 315 is coupled with one of the branch passages that are branched off the main gallery 184 and surplus lubricant that has passed through the first bearing section 122 is delivered to the module 315. Accordingly, no specific delivery passage is necessary to connect the delivery paths in the module 315 with the main gallery 184. The lubrication system thus can be simpler and the amount of the lubricant delivered to the module 315 is well balanced with the amount of the lubricant that is delivered to other engine portions.

Also, in the illustrated arrangement, the upper-most branch passage 202 and the delivery passage 206 are used as the route delivering the lubricant to the module 315. The passages 202, 206 are defined at the top wall of the cylinder block 74. Accordingly, these passages 202, 206 can be formed quite easily. Additionally, the upper-most journal bearing 120 at the crank journal 86 needs less lubricant than the other journal bearings 120 because no delivery passage that delivers the lubricant to the crank pin or further portions exists. The surplus lubricant at this bearing portion can be delivered to the module 315 without causing any troubles accordingly.

The lubricant, however, can be delivered to the balancer module 315 from the main gallery 184 without passing through the branch passage 202 and the delivery passage 206. For instance, another delivery passage that bypasses the bearing blocks 102, 110 can be provided in a modified arrangement.

As described above, the lubricant that has lubricated the first bearing section 122 and the journal bearings 134 is scattered by the relatively high speed rotation of the crankshaft 84. A portion of such lubricant scattered into the balancer module 315 has difficulty in returning back to the lubricant tank 182 because the module 315 forms rough surfaces due to the components therein and the lubricant can adhere thereto and additionally because the balancer shafts 250, 252 also scatter the lubricant.

With reference to FIGS. 3–5, the illustrated engine 32 incorporates a baffle 354 extending generally vertically and affixed to the crankcase member 80. The baffle 354 is generally formed as an arcuate shape opening toward the crankshaft 84. Several slots 356 are formed in the baffle 354 such that portions of the respective gears 274, 278, 290 and the bearing caps 302, 304 can pass therethrough. The baffle 354 separates the balancer module 315 from the crankshaft 84. The lubricant scattered by the crankshaft 84 adheres to the baffle 354 and falls down to the lubricant tank 182 as indicated by the arrows 355 of FIG. 4.

With particular reference to FIG. 5, a portion 356 of the baffle 354 on the port side (left hand side) extends generally along the drive gear 160. Due to a space 358 formed between the baffle 354 and the inner wall of the crankcase member 80, the scattered lubricant can enter the space 358 as indicated by the arrow 360. The crankcase member 80 preferably has a projection 362 extending toward the portion 356 of the baffle 354. The lubricant that enters the space 358 thus is inhibited from entering the balancer module 315 and falls down to the lubricant tank 182.

With continued reference to FIG. 5, another portion 364 of the baffle 354 on the starboard side (right hand side) extends along the drive gear 160 and then turns toward the inner wall of the crankcase member 80. The portion 364 thus closes this side of the balancer module 315. The scattered lubricant has inertia that orients the lubricant oppositely to the module 315 on this side. In addition, because the portion 364 prevents the lubricant from entering the module 315, the lubricant does not enter the module 315 and falls down to the lubricant tank 182 along the baffle 354.

In some alternative arrangements, the baffle 354 can have other configurations. For example, a flat shape is practicable. Moreover, the baffle 354 can be removed if a sufficient amount of the lubricant can be kept in the lubricant tank 182.

Of course, the foregoing description is that of preferred arrangement and alternatives having certain features, aspects and advantages in accordance with the present invention. Various changes and modifications also may be made to the above-described arrangements without departing from the spirit and scope of the invention, as defined by the claims.

What is claimed is:

1. An internal combustion engine comprising an engine body defining first and second bearing sections, a crankshaft journaled at the first bearing section for rotation about a first axis extending generally vertically, a balancer shaft journaled at the second bearing section for rotation about a second axis extending generally parallel to the first axis, the crankshaft rotating the balancer shaft, the balancer shaft having at least one balancer weight, and a lubrication system arranged to deliver lubricant to the first and second bearing sections, the first bearing section comprising an uppermost bearing portion and at least one lower bearing portion spaced apart vertically from the uppermost bearing portion, the lubrication system defining a main gallery and a plurality of delivery passages coupled with the main gallery, a portion of the lubricant being delivered to the uppermost bearing portion through a first delivery passage, another portion of the lubricant being delivered to the second bearing section through the first delivery passage, the first delivery passage exclusively providing lubricant to the balancer shaft.

2. The engine as set forth in claim 1, wherein the delivery passage to the second section incorporates at least a portion of one of the two delivery passages.

3. The engine as set forth in claim 2, wherein the one of the two delivery passages delivers the portion of the lubricant to the upper bearing portion.

4. The engine as set forth in claim 1, wherein the crankshaft has a first gear, the balancer shaft has a second gear, the first and second gears mesh with each other.

5. The engine as set forth in claim 4, wherein the crankshaft has at least one crank web, the first gear is affixed to the crank web.

6. The engine as set forth in claim 1, wherein the engine body comprising a housing member defining the second bearing section, the housing member enclosing at least a portion of the balancer shaft, and the housing member defining a lubricant return path.

7. The engine as set forth in claim 1, wherein the engine powers a marine propulsion unit.

8. An internal combustion engine comprising an engine body defining first and second bearing sections, a crankshaft journaled at the first bearing section for rotation about a first axis extending generally vertically, a balancer shaft journaled at the second bearing section for rotation about a second axis extending generally parallel to the first axis, the crankshaft rotating the balancer shaft, the balancer shaft having at least one balancer weight, and a lubrication system arranged to deliver lubricant to the first and second bearing sections, the engine body comprising first, second and third members, the first member defining at least a portion of the first bearing section, the second member defining at least a portion of the second bearing section, the first and second members together defining a lubricant delivery passage, the lubricant flowing from a portion of the delivery passage at the first member to another portion of the delivery passage at the second member, the third member defining another portion of the first bearing section, the third member defining a main gallery of the lubrication system, the delivery passage being coupled with the main gallery such that the lubricant flows from the main gallery to the delivery passage, wherein the first member defines an opening, the second member closes the opening.

9. The engine as set forth in claim 8, wherein the first member defines an opening, the second bearing section extends toward the opening.

10. The engine as set forth in claim 8, wherein the second member is detachably affixed to the first member.

11. An internal combustion engine comprising an engine body defining first and second bearing sections, a crankshaft journaled at the first bearing section for rotation about a first axis extending generally vertically the first bearing section including a first main bearing at a top of the crankshaft and at least one lower bearing, a first balancer shaft journaled at the second bearing section for rotation about a second axis extending generally parallel to the first axis, the first main bearing being the uppermost bearing and being located above the first balancer shaft, a second balancer shaft journaled at the second bearing section for rotation about a third axis extending generally parallel to the second axis, the crankshaft rotating the first and second balancer shafts, each of the first and second balancer shafts having at least one balancer weight disposed lower than the first main bearing, and a lubrication system including a main gallery extending through the engine body generally parallel to the first axis and configured to deliver lubricant to the first and second bearing sections, the lubrication system delivering the lubricant to bearing portions of the first and second balancer shafts, the lubrication system defining at least one lubricant passage extending from the main gallery to the first main bearing, and at least a second passage extending from the first main bearing and bifurcating toward the bearing portions of the first and second balancer shafts.

12. The engine as set forth in claim 11, wherein the lubricant passage passes through a portion of the first bearing section.

13. An internal combustion engine comprising an engine body defining first and second bearing sections, a crankshaft journaled at the first bearing section for rotation about a first axis extending generally vertically, a balancer shaft journaled at the second bearing section for rotation about a second axis extending generally parallel to the first axis, the crankshaft rotating the balancer shaft, the balancer shaft having at least one balancer weight, a lubrication system arranged to deliver lubricant to the first and second bearing sections, and a baffle arranged to separate the balancer shaft from the crankshaft.

14. The engine as set forth in claim 13, wherein the engine body and the baffle together inhibiting the lubricant from approaching the balancer shaft from the crankshaft.

15. An internal combustion engine comprising an engine body defining first and second bearing sections, a crankshaft journaled at the first bearing section for rotation about a first axis extending generally vertically, a balancer shaft journaled at the second bearing section for rotation about a second axis extending generally parallel to the first axis, the crankshaft rotating the balancer shaft, the balancer shaft having at least one balancer weight, and a lubrication system arranged to deliver lubricant to the first and second bearing sections, the first bearing section comprising upper and lower bearing portions spaced apart vertically from each other, the lubrication system defining at least first and second delivery passages, a first portion of the lubricant being delivered through the first passage to lubricate the upper bearing portion, a second portion of the lubricant being delivered through the second delivery passage to lubricate the lower bearing portion, and at least part of the first or second portions of the lubricant passing through the first or second delivery passages being delivered to the second bearing section, wherein the first portion of the lubricant is delivered to the second bearing section through the first delivery passage, and wherein the second bearing section is positioned lower than the first delivery passage.

* * * * *